United States Patent [19]

Simpson

[11] 4,214,751

[45] Jul. 29, 1980

[54] ADJUSTABLE BUNTING BAT WITH PROTECTIVE SHIELD

[76] Inventor: John P. Simpson, 36 Winthrop Rd., Brentwood, N.Y. 11717

[21] Appl. No.: 901,344

[22] Filed: May 1, 1978

[51] Int. Cl.[2] ..... A63B 59/00

[52] U.S. Cl. ..... 273/26 B

[58] Field of Search ..... 273/26 B, 72 R, 72 A, 273/73 J, 80.1, 80.2, 81.2; 403/109, 350, 111, 165, 343, 358, 409

[56] References Cited

U.S. PATENT DOCUMENTS

| | | | |
|---|---|---|---|
| 2,397,282 | 3/1946 | Smith | 403/350 |
| 2,473,351 | 6/1949 | Thompson et al. | 403/109 X |
| 3,084,938 | 4/1963 | Kapanowski | 273/72 |
| 3,227,455 | 1/1966 | Hulsman | 273/81.2 |
| 3,955,816 | 5/1976 | Bratt | 273/26 B |

FOREIGN PATENT DOCUMENTS

| | | | |
|---|---|---|---|
| 91719 | 1/1938 | Sweden | 403/350 |
| 15565 | of 1902 | United Kingdom | 273/72 R |

OTHER PUBLICATIONS

Philadelphia Sunday Bulletin, May 17, 1953.

*Primary Examiner*—Richard C. Pinkham
*Assistant Examiner*—T. Brown
*Attorney, Agent, or Firm*—Kane, Dalsimer, Kane, Sullivan & Kurucz

[57] ABSTRACT

A training bat having an adjustable handle capable of insertion within or extension from the barrel of the bat. When inserted within the bat, a player is able to master the technique of bunting by holding it with one hand as he would a glove. When the handle is fully extended, the batter may practice bunting in the conventional manner with two hands. A twist lock is provided for maintaining the handle in the extended position, and a beveled portion of the handle frictionally engages the barrel portion for maintaining the handle in the inserted position. A protective shield is provided for protecting the batter's hand while practicing bunting techniques. A novel technique for mastering the art of bunting is also disclosed.

6 Claims, 8 Drawing Figures

FIG. 3
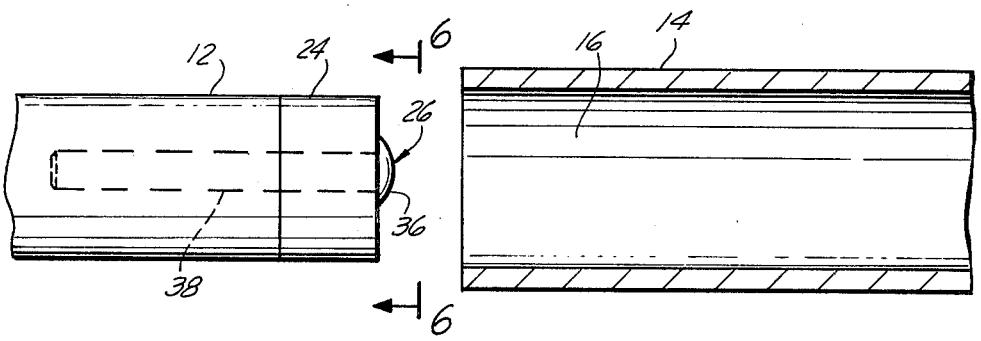
FIG. 4
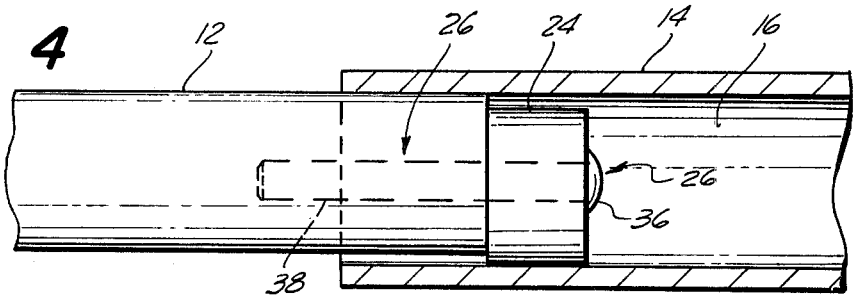
FIG. 5
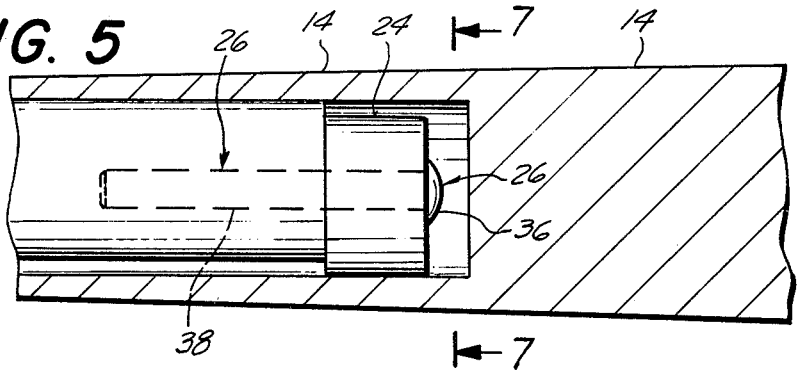
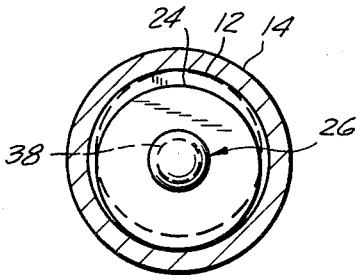
FIG. 7

ADJUSTABLE BUNTING BAT WITH PROTECTIVE SHIELD

BACKGROUND OF THE INVENTION

The field of the invention concerns a technique for mastering the art of bunting, and a bat having an adjustable handle which is designed for practicing the technique. One of the more important aspects of the game of baseball/softball is the technique of bunting. This technique requires the player to bat the ball lightly into the infield without swinging the bat. Unfortunately, this aspect of the game presents one of the more difficult training problems. When teaching the art of bunting, the instructor most demonstrate, and the batter assume, an unnatural stance that creates some uncertainty and apprehension on the part of the batter. These problems become a hinderance for the batter and consequently inhibit his learning the art of bunting.

SUMMARY OF THE INVENTION

The adjustable bunting bat was designed to overcome the above mentioned problems.

The invention comprises a bat having a handle, a barrel, and means for moving the handle in or out of the barrel to provide "closed" or "open" positions, respectively. When the bat is in the closed position, it is considerably shorter than when the handle is extended. This allows the batter to manipulate the bat more easily. Starting with the bat in this position, the player should grasp the bat under a protective shield which is affixed to the bat and assume the normal batting position. The body is parallel to home plate in the normal position instead of facing the pitcher. When the pitcher releases the ball, the batter is instructed to simulate catching rather than hitting the ball. The bat in the closed position thereby acts as a glove in this situation.

This technique allows the player to learn the art of bunting more easily as the bat facilitates the interchange of knowledge and expertise inherent in the technique of catching to the technique of bunting.

After the first phase of the bunting technique is mastered, the batter would open the bat to the fully extended position and continue the training process. A locking means is provided to prevent the handle from slipping back into the barrel.

A more practical and innovative technique for teaching the art of bunting is accordingly provided. A bat of novel construction is also provided for implementing the technique. These are two important objects of the invention.

Another object of the invention is to provide a bat which can be designed for a player of any size or age.

Another object of the invention is to provide a training bat which is easily manipulated into open and closed positions, and which has means to maintain those positions.

Still another object of the invention is to provide a bat which is economical to manufacture.

Other objects and advantages of the invention will become apparent in the detailed description which follows.

BRIEF DESCRIPTION OF THE DRAWINGS

FIG. 3 is a partially exploded view of the invention showing the handle and barrel portions of the bat;

FIG. 4 is a sectional view showing the position of the twist lock when the handle is fully extended;

FIG. 5 is a sectional view showing the position of the twist lock when the handle is fully inserted within the barrel;

FIG. 7 is a cross sectional view taken along line 7—7 of FIG. 5;

DETAILED DESCRIPTION OF THE INVENTION

The invention pertains to an innovative technique for learning the art of bunting, and a novel bat designed for carrying out the technique.

Figure 1:
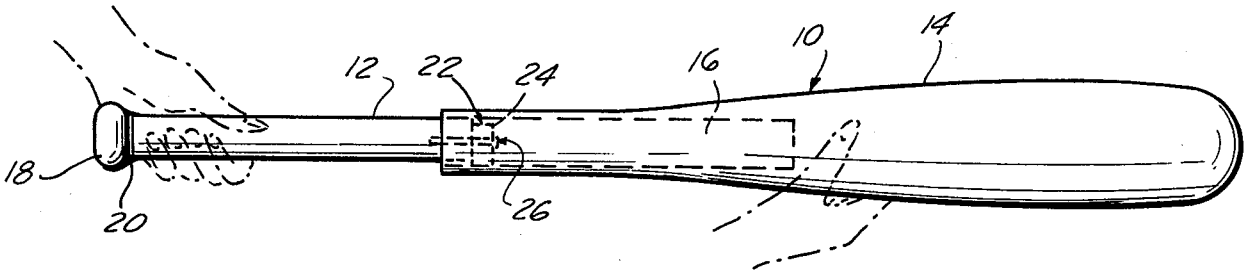
FIG. 1 is a side view of the novel bat with its handle fully extended into the open position.
Figure 2:
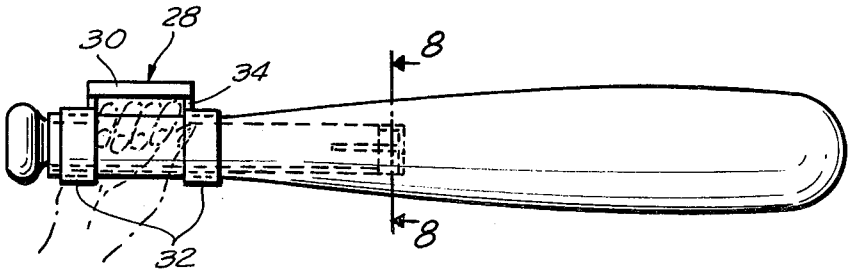
FIG. 2 is a similar view showing the bat with its handle in the closed position.
Figure 6:
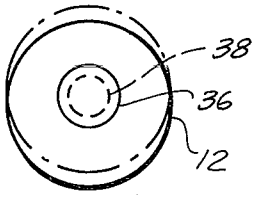
FIG.6 is a top view of the handle taken along line 6—6 of FIG. 3 showing movement of the eccentric in phantom.

The bat 10 is most clearly shown in FIGS. 1 and 2, and includes a handle 12 and a barrel 14. The barrel contains a hollow portion 16 which extends about half way therethrough. The handle 12 includes a knob 18 on one end with a tapered portion 20 extending from the knob to the main part of the handle. The other end of the handle contains a "twist lock" 22 comprising a hard plastic cylindrical piece or "cam" 24 which is eccentrically and rotatably mounted to the handle by a screw 26. The head 36 of the screw holds the cam 24 in position while the threaded portion 38 secures it to the handle. (See FIGS. 3–7). The handle may be tilted slightly within the barrel such that only the cam contacts the inner wall of the barrel. In this manner, relative displacement of the cam and handle may occur by twisting the handle. Alternatively, a relatively tight fit may exist between the barrel and the handle and cam which would allow the lateral displacement of the cam upon rotation of the handle.

Figure 8:
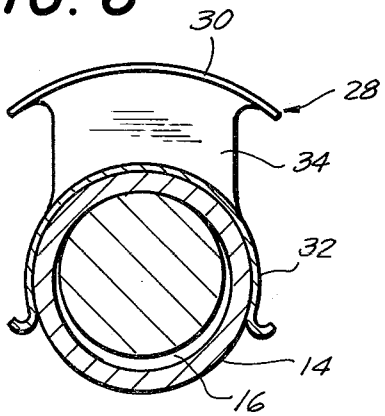
FIG. 8 is a cross sectional view taken along line 8—8 of FIG. 2.

As shown in FIGS. 2 and 8, a protective shield 28 may be secured to the bat. The shield 28 includes a shield portion 30, clamps 32, and connecting pieces 34.

The training procedure begins with the bat in the closed position as shown in FIG. 2. The protective shield 28 is clamped to the barrel 14, and the player grips the bat under the shield. Frictional engagement of the tapered portion 20 of the handle 12 with the barrel 14 prevents the barrel from sliding out when the bat is in the closed position.

The batter assumes the normal batting position with his body parallel to home plate. When the pitcher releases the ball, the batter is instructed to simulate "catching" the ball with the bat rather than hitting it. Since most players are more adept at catching than bunting, the technique facilitates the interchange of knowledge and expertise inherent in the technique of catching to the art of bunting. The batter's task of keeping his eye focussed on the ball is greatly simplified with the closed bat, and movement of the bat to meet the ball wherever pitched is facilitated.

The protective shield guards the hands when the bat is in the closed position, and can be removed when the bat is fully extended for the next training phase. The second phase begins after the player has mastered the technique using the closed bat. Due to the novel construction of the bat 10, it is unnecessary to switch to a standard bat.

The handle is extended by pulling the knob 18 away from the barrel. It may first be necessary to tap the knob on the ground to break the frictional engagement of the tapered portion 20 with the barrel. When the handle has been sufficiently extended to the liking of the player, it is twisted relative to the barrel to lock it in place. Locking is accomplished by means of the cam 24 which is eccentrically secured to the end of the handle opposite the knob 18 by a screw 26. When the cam is positioned as shown in FIG. 3, it slides easily within the barrel as there is little frictional contact between them. When the handle is withdrawn to the position as illustrated in FIG. 4, it is twisted such that the cam is increasingly displaced relative to the center of the handle. The cam and handle portion within the hollow barrel are forced against the walls of said barrel creating a friction fit which prevents relative movement of the handle and barrel. This "twist lock" arrangement can also be employed when the bat is in the closed position. (Note FIG. 5).

To release the handle, it can be twisted again until the cam 24 substantially reassumes the position shown in FIG. 3.

When the bat is in the open or extended position, the batter will train in the conventional manner using both hands for guiding the bat. Due to his experience with the closed bat, he will be able to master the art of bunting with the standard (open) bat more easily.

It can be seen that an innovative technique for mastering the art of bunting has been provided, as well as a novel bat for practicing the technique. The bat is economical to manufacture, simple to operate, and may provide protection for the player's hand. Although somewhat preferred embodiments have been disclosed in the application, they are intended for descriptive purposes only and should not be construed as limiting the invention in any manner. The scope of the invention should accordingly be determined in light of the appended claims.

What is claimed is:

1. An adjustable standard baseball bat for reducing the length of the bat from its normal length to a reduced length for use as a training device in practicing the art of bunting a baseball, comprising:

a barrel having a cavity extending axially therein, a handle within said cavity and movable therein from an open position to a closed position in which a substantial portion of said handle is substantially fully inserted within said cavity, and means for locking said handle within said barrel in either said open or said closed positions, whereby a batter may simulate the catching of a baseball while holding the barrel of said bat when said handle is in a closed position, the shape of the bat having substantially the form of the barrel when the handle is in the closed position.

2. An adjustable bat as described in claim 1 wherein a first end of the handle portion includes an eccentrically attached member, said first end being adapted for insertion within said cavity and said eccentrically attached member adapted for frictionally engaging the barrel upon relative rotation of the handle.

3. An adjustable bat as described in claim 2 wherein a second end of the handle portion includes a knob and a tapered surface extending from said knob to the remainder of the handle, said tapered surface adapted for frictionally engaging the barrel when the handle is fully inserted within said barrel.

4. An adjustable bat as described in claim 2 wherein the eccentric member is cylindrical and attached to the handle by a screw.

5. An adjustable bat as described in claim 1 or claim 3 wherein a protective shield is attached to said barrel for protection of a hand of a batter.

6. An adjustable bat as described in claim 5 wherein the protective shield includes clamping means for securing the shield to the bat.

* * * * *